United States Patent [19]

Goldfarb et al.

[11] 4,298,915

[45] Nov. 3, 1981

[54] NIGHT LIGHT APPARATUS

[75] Inventors: Adolph E. Goldfarb, 4614 Monarca Dr., Tarzana, Calif. 91356; Elonne Dantzer, Redondo Beach, Calif.

[73] Assignee: Adolph E. Goldfarb, Tarzana, Calif.

[21] Appl. No.: 10,923

[22] Filed: Feb. 9, 1979

[51] Int. Cl.[3] ..... F21P 1/02

[52] U.S. Cl. ..... 362/124; 362/190; 362/295; 362/808

[58] Field of Search ..... 362/124, 190, 295, 808

[56] References Cited

U.S. PATENT DOCUMENTS 1,454,799 5/1923 Usher ..... 362/124

*Primary Examiner*—Stephen J. Lechert, Jr.

*Attorney, Agent, or Firm*—Romney, Golant, Disner & Ashen

[57] ABSTRACT

A child's night light in the form of a holdable doll figure having a movable portion such as an arm which may be raised and lowered. The arm may hold an object such as a representation of a lantern or candle that holds a light bulb which automatically goes on when the arm is raised and goes off when the arm is lowered. The light bulb may be provided with a suitable light-diffusing cover, and it may be so positioned, when raised, to fully illuminate the three-dimensional contoured face of the doll without undesirable dark, scary shadow effects as would frighten the child. The doll may have a soft holdable body with at least the movable arm being a rigid molded part pivotally mounted at the shoulder of the doll. An off-on switch may be provided at the shoulder and be operable by the pivotal movement of the arm. The lantern may be detachable and may contain batteries that are electrically connected to the light bulb through the switch. The arm may be biased to the lowered position to automatically turn off the light when the arm is released.

19 Claims, 9 Drawing Figures

FIG. 1
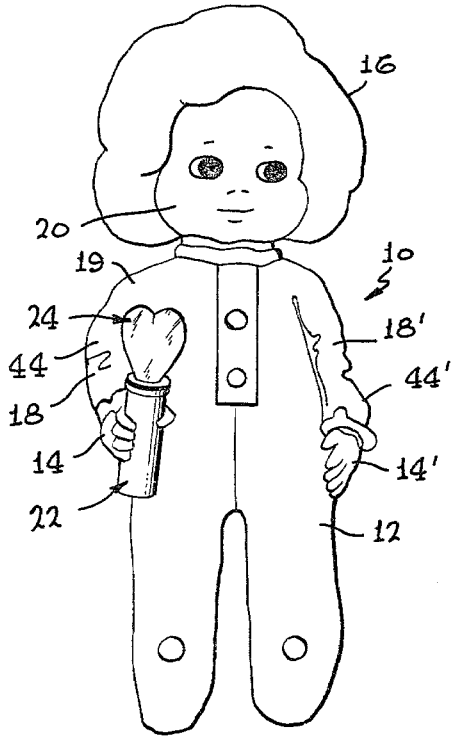
FIG. 3
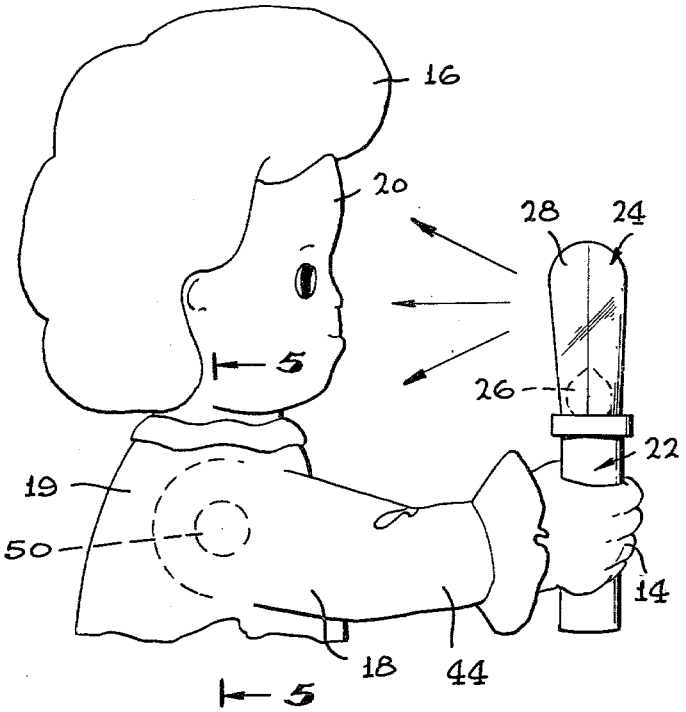
FIG. 2
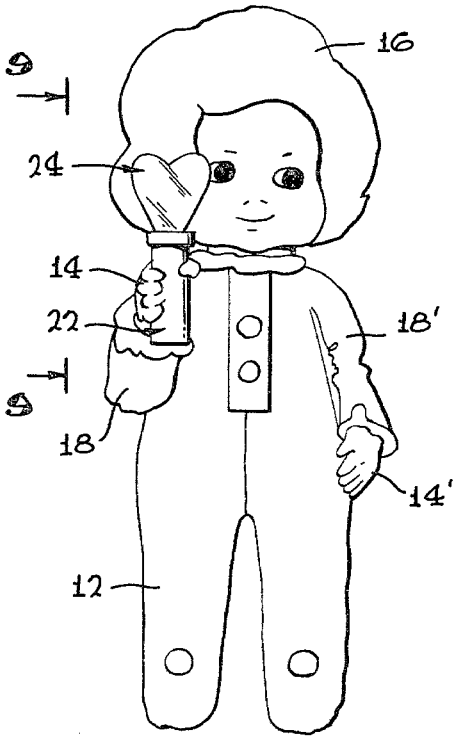
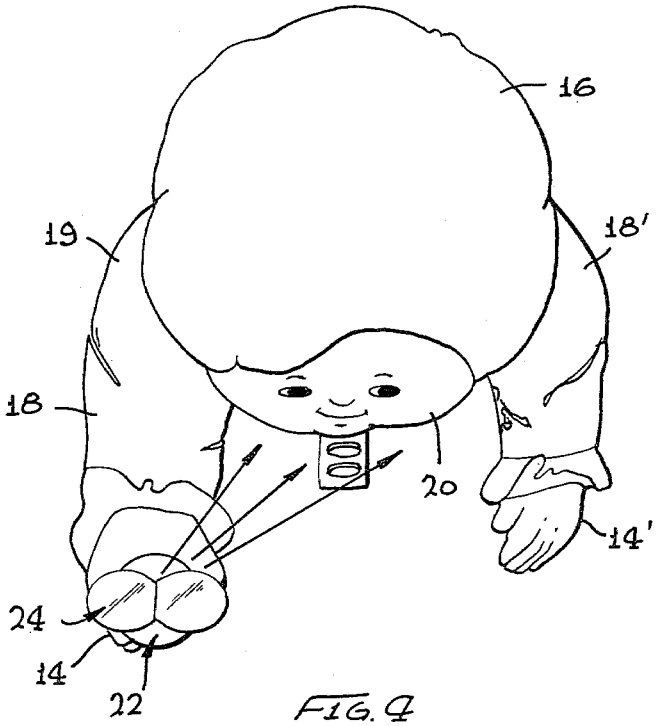
FIG. 4

FIG. 7
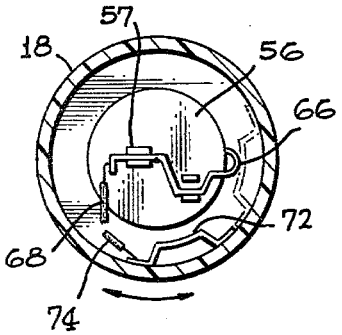
FIG. 5
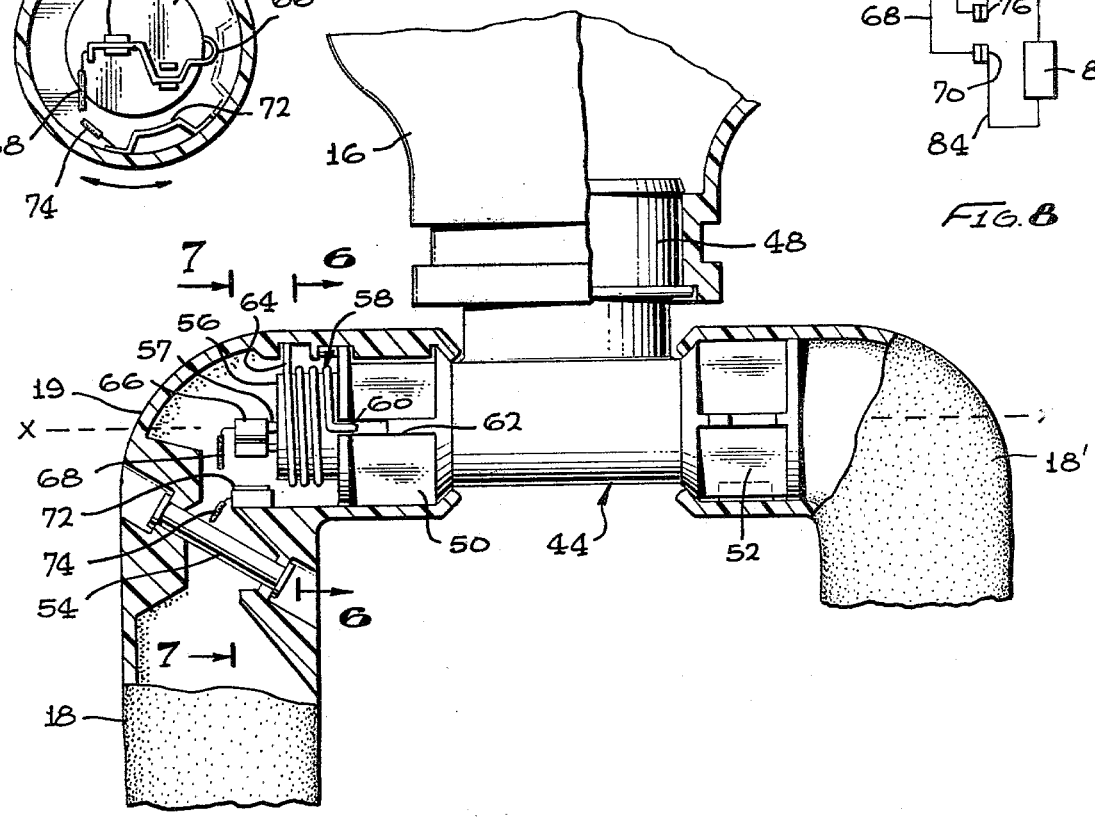
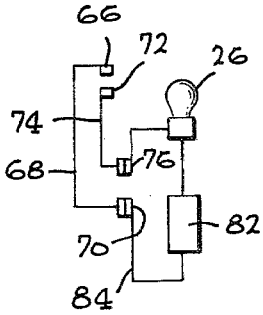
FIG. 8
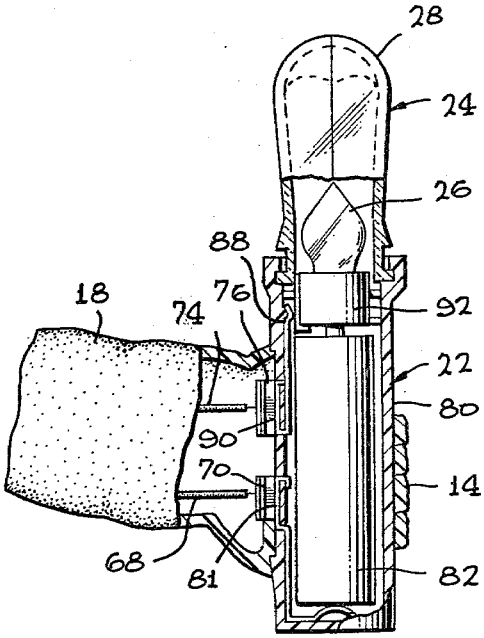
FIG. 9
FIG. 6
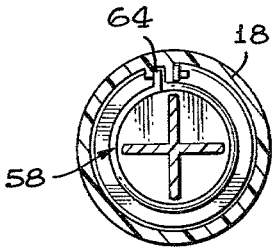

NIGHT LIGHT APPARATUS

The invention relates generally to night light apparatus for young children and more particularly to such a night light in the form of a doll or figure having an arm which moves to automatically turn on the light.

There have been a variety of night lights and night light devices in the past proposed for use by young children. To applicant's knowledge there has never been any effective night light for young children which obviated one major disadvantage possessed by all of such prior devices. Because such devices were used in a room which was otherwise darkened and because the night light itself was small, shining the small light against the face of a doll or figure would tend to create dark eerie and scary shadows so that the purpose of reassuring and calming the child in the darkness was generally not accomplished.

The night light apparatus of the present invention to the contrary provides an arrangement of the light relative to the face of the night light doll or figure such that the face is fully illuminated without such dark shadows so that a soft and reassuring image is presented to the child and the child is comforted thereby. In particular, the light is provided in front of and slightly off to one side of the face so that a minimum of shadow effect is provided and no dark or substantial shadows are formed. The illustrated device is a soft holdable, self contained doll which the child can take to bed, and which will automatically turn off when it is released.

In the drawings:

FIG. 1 is a front elevational view of a night light doll presenting a presently preferred embodiment of the invention, showing the light in a lowered "off" position;

FIG. 2 is a view like FIG. 1, but showing the light in a raised "on" position;

FIG. 3 is an enlarged side elevational view of the night light doll, in the position shown in FIG. 2;

FIG. 4 is an enlarged top plan view of the night light doll, in the position shown in FIG. 2;

FIG. 5 is an enlarged front elevational view, partly broken away and in section, of the internal rigid structure of the arms, head, and supporting mandrel (taken along 5—5 of FIG. 1;

FIG. 6 is a sectional view taken generally along line 6—6 of FIG. 5;

FIG. 7 is a sectional view taken generally along line 7—7 of FIG. 5; and FIG. 8 is a schematic electrical diagram of the circuit of the doll.

FIG. 9 is an enlarged broken away view along 9—9 of FIG. 2.

The illustrated night light doll or figure apparatus 10 is a presently preferred embodiment of the invention. In general, the night light apparatus 10 comprises a soft doll 12 which has a means that supports a head 16 and at least one movable rigid arm 18. The arm 18 is pivotally supported at the shoulder 19 of the doll. The head 16 includes a face 20. The movable arm 18 has a hand 14 which holds an object 22 representing a light source. The illustrated object 22 is in the form of a lantern having a heart-shaped illuminatable end or light section 24 comprised of a light bulb 26 within a light-diffusing cover or lense 28. The arm 18 is movable to a position as shown in FIGS. 2, 3 and 4, where the light section 24 is adjacent to the face 20 and fully illuminates the face. The light bulb 26 automatically goes on when the hand is raised to the position in FIGS. 2, 3 and 4. The light bulb 26 will go off when the arm is lowered to the position shown in FIG. 1. The doll 10 includes an electrical circuit means 30 which is schematically illustrated in FIG. 8. The circuit means 30 includes a switch or switch means 32 which is located at the shoulder 19 where the arm 18 is pivotally mounted, and which opens when the arm is lowered to turn off the light bulb. The lantern 22 also houses one or more batteries 34 to provide energy to the light bulb 26. A spring 58 biases arm 18 to the lowered position where the light is off.

When the hand is raised so that the light section 24 is illuminated, it wil be noted that the light section is positioned in a very specific location relative to the face of the doll. This positioning is important in providing a suitable night light for younger children in that improper positioning of the light will result in substantial and dark shadows on the face of the doll which will be frightening to the child. The position of the illustrated light as shown in FIGS. 2, 3 and 4 is to the front and also at the right side of the face to thereby minimize such undesirable shadow effect without blocking the face.

In general, the illustrated doll 12 may comprise a casing 40 of cloth or the like and be filled with suitable stuffing material 42 such as cotton batting. The means 13 to support the head 16 and arm 18 may be in the form of a rigid mandrel 44 of molded plastic or the like secured within the casing 40 at its upper end. The head 16 and arm 18 may also be rigid molded plastic parts connected to the mandrel 44. The arm 18 may extend through an arm section 46 of the casing, with the hand 14 exposed. The illustrated doll 12 has a second rigid molded arm 18' which is mounted on the mandrel, extends through an arm section 46', and has an exposed hand 14' at its end.

Now to consider the interior structure of the doll 12 in further detail and in particular the mandrel 44 and the arm 18. As shown in FIG. 5, the mandrel has an inverted T-shaped configuration with an upwardly extending main hub 48 on which a conventional rotationally molded head 16 may be rotatably supported in a manner well known in the art. The mandrel 44 also includes a pair of oppositely extending hubs 50 and 52 on which the doll arms 18 and 18' are rotatably mounted. In particular, it will be noted that the illustrated arms 18 and 18' are generally hollow and may each be comprised of two halves secured together as by means of a bolt such as illustrated at 54. The halves of the arms 18 and 18' are formed so that when they are assembled about the hubs 50 and 52 and secured together, the arms 18 and 18' are each fixedly secured to the mandrel 44 and rotatable about the generally transverse axis indicated at X—X. The hub 52 is provided with a central extension portion 56 around which a helically wound torsion spring 58 is disposed. One end 60 of the spring 58 is secured to the hub 52 as by being received in a slot 62, while the other end 64 of the spring is secured to the arm 18 as shown best in FIG. 6. The spring 58 tends to bias the arm 18 to the position shown in FIG. 1 where the switch is open and the light is off. This position is illustrated in FIG. 5. When the arm is moved against the spring to the position shown in FIG. 2, the switch is turned on as will be explained in further detail.

Also mounted on the extension 56 as by means of holding tabs 57 is a first electrical switch contact 66 to which one end of an electrical lead wire 68 is attached. The wire 68 extends through the hollow arm 18 and it is secured to its other end to an electrical conductor block 70 in the hand 14. A second electrical switch contact 72 is mounted on the arm 18 adjacent the first contact 66. The contact 72 is connected to one end of an electrical lead wire 74 which extends down through the arm 18 and is connected at its other end to an electrical conductor block 76 also in the hand 14. As shown in FIG. 7, when the arm 18 is rotated from its downwardly extending or lower position as shown in FIG. 1 to the raised position as shown in FIG. 2, the switch is closed. In this regard, the second contact 72 which is carried on the arm 18 is brought into physical and electrical contact with the first contact 66 mounted on the doll body (as shown in broken line in FIG. 7).

As noted above, the object 22 which is held by the illustrated doll is a hand-holdable lantern having a heart-shaped illuminatable light section 24 at its upper end. The lantern 22 is releasably held by the hand 14 of the doll as shown in FIG. 5. The lantern 22 may be removed by flexing the hand. The illustrated lantern 22 includes a generally cylindrical lower housing 80 which houses a conventional battery 82. As shown in FIG. 5, the lower end of the battery 82 is supported on and in contact with a first metal conductor strip 84 which is disposed within the cylindrical housing 80 and extends part way up the side of the housing. The upper end 86 of the strip 84 extends outwardly through the wall of the housing 80 to provide an electrical contact surface 86. This surface 86 is in electrical and physical contact, when the housing 80 is received in the hand 14, with the electrical contact block 70. Similarly, another electrical conductor strip 88 is disposed within the upper portion of the housing 80 and it has a lower end portion 90 which extends through the wall of the housing 80 and presents an external contact surface which makes physical and electrical contact with the other electrical contact block 76 in hand. The strip 88 extends upwardly to a receptacle or socket 92 which receives the light bulb 26. The strip 88 is arranged to be electrically connected to one contact of the bulb 26 when the bulb is in the socket. When the bulb is in the socket 26, it has its other contact electrically connected to the battery 82.

Thus, as shown in the electrical schematic drawing of FIG. 8, the battery 82 is connected to the light bulb 26, and each is connected through a contact block 70, 76 and an electrical lead wire 68, 74 to one of the contacts 66, 72 of the switch means 32. Thus when the switch means is closed, the circuit is completed and the bulb is lighted.

As also noted above, the lantern 22 has a heart-shaped cover 28 of a relatively clear plastic which surrounds the bulb 26. The cover 28 may be tinted, frosted or otherwise translucent to diffuse the light emanating from the bulb.

Thus, the arm 18 is normally biased to the position shown in FIG. 1 by the spring 58 and the switch contacts 66 and 72 are out of engagement to open the circuit so that the light bulb 26 is not energized. When the child raises the arm of the doll to the position shown in FIGS. 2, 3 and 4, the switch contacts 66 and 72 are brought into engagement which closes the circuit and lights the bulb 26. The location of the light section 24 when the bulb is lit is illustrated in FIGS. 2, 3 and 4, and as noted above is such as to fully illuminate the three-dimensional contoured face of the doll with a minimum amount of shadow or darkness such as would tend to frighten the child. In addition, the doll is soft and holdable by the child and is self-contained without any external wires or connections. The child can take the doll to bed, can operate the arm when desired to turn on the night light for needed comfort, and when the child falls asleep the arm will automatically be biased by the spring to the lowered position where the light will go out to conserve the batteries and permit the child to sleep in the darkened room.

Various modifications and changes may be made in the illustrated structure without departing from the spirit and scope with the present invention as set forth in the following claims.

What is claimed is:

1. A night light apparatus for a child comprising:

(a) means defining a representation of at least a portion of a figure, including a three-dimensional contoured face made of opaque material;

(b) movable means movably supported on said figure-defining means and defining a representation of an extremity of the figure, said movable means including means for supporting a light source, said movable means being movable between a first position and a second position; and (c) electrical circuit means on said figure-defining means and electrically connected to said light source support means, said circuit means including an off/on switch operatively associated with said movable means so that said switch is on when said movable means is in said first position and said switch is off when said movable means is in said second position, said movable means being proportioned and configured so that when said movable means is in said first position and said switch is on, the light source is in close proximity to the face and so positioned relative to the face that the light from the light source will fully illuminate the face without creating any significant amount of shadow on said face.

2. A night light apparatus as called for in claim 1 wherein said movable means is in the form of a rigid arm having a hand at its outer end, said arm being pivotally mounted at its opposite end on said figure defining means.

3. A night light apparatus as called for in claim 2 wherein said off/on switch means comprises one contact on said arm and the other contact on said figure-defining means.

4. A night light apparatus as called for in claim 1 wherein said electrical circuit means includes means for holding one or more batteries, said battery holding means being electrically connected to said light source support means through said off/on switch means, whereby electrical energy is provided to a light source supported in the light source support means when said switch means is on.

5. A self-contained night light doll for a child comprising:

(a) a three-dimensional doll figure having a soft body, a head supported on said body and including a contoured face made of opaque material, and movable means movably supported on said doll figure and defining a representation of an extremity of the figure, said movable means including means for supporting a light source, said movable means being movable between a first position and a second position; and (b) electrical circuit means on said figure and connected to said light source support means, said circuit means including an off/on switch means operatively associated with said movable means so that said switch means is on when said movable means is in said first position and said switch means is off when said movable means is in said second position, said movable means being proportioned and configured so that when said movable means is in said first position and said switch means is on, said light source is in close proximity to the doll face and so positioned relative to the face that the light from the light source will fully illuminate the face.

6. A night light doll as called for in claim 5 wherein said movable means is in the form of a rigid arm pivotally supported on said doll figure.

7. A night light doll as called for in claim 6 further including a rigid mandrel supported within said soft body of the doll figure and having a portion on which said rigid arm is pivotally supported.

8. A night light doll as called for in claim 7 wherein said switch means is comprised of a pair of contacts, one contact mounted on said rigid arm and the other contact mounted on said mandrel adjacent to said one contact.

9. A night light doll as called for in claim 6 wherein said arm has a hand at its outer end where said light-source supporting means is disposed.

10. A night light doll as called for in claim 9 wherein said electrical circuit means includes means for holding one or more batteries to provide electrical energy to said light source support means when said switch means is on.

11. A night light doll as called for in claim 10 wherein said battery-holding means is disposed at the hand of said doll.

12. A night light doll as called for in claim 11 wherein said arm is hollow and said switch means comprises a contact mounted at the upper end of said arm and a mating contact on said body adjacent to said arm, and further comprising electrical lead wires extending through said hollow arm and each connecting one of said switch contacts with said light source support means and said battery holding means at the hand of said doll.

13. A night light doll as called for in claim 5 wherein said movable means is biased to said second position.

14. A night light doll as set forth in claim 5 wherein said movable means comprises an elongated arm having a hand at its outer end, said hand being formed to define a receptacle, said means for supporting a light source being removably disposed in said receptacle and including contact means for establishing electrical contact, when said light source-supporting means is in said receptacle, between said light source-supporting means and said switch means.

15. A night light doll as set forth in claim 5 wherein said light source-supporting means comprises a holder for a light bulb and a diffusing cover extending at least between the area where the light bulb is supported and the face of the doll.

16. A night light doll as set forth in claim 15 wherein said cover encloses the area where the light bulb is supported.

17. A night light doll as called for in claim 1 wherein said movable means is biased to said second position.

18. A night light apparatus as called for in claim 1 wherein the light source is supported, when said movable means is in the first position, in front of and at one side of the face of the figure.

19. A night light doll as called for in claim 5 wherein the light source is supported, when said movable means is in the first position, in front of and at one side of the face of the figure.

* * * * *